US005495642A

United States Patent [19]

Trützschler

[11] Patent Number: 5,495,642

[45] Date of Patent: Mar. 5, 1996

[54] METHOD AND APPARATUS FOR DETACHING FIBER TUFTS FROM TEXTILE FIBER BALES AS A FUNCTION OF BALE HEIGHT

[75] Inventor: Hans Trützschler, Mönchengladbach, Germany

[73] Assignee: Trützschler GmbH & Co. KG, Mönchengladbach, Germany

[21] Appl. No.: 311,589

[22] Filed: Sep. 23, 1994

[30] Foreign Application Priority Data

Sep. 24, 1993 [DE] Germany ..... 43 32 496.7
Jun. 28, 1994 [DE] Germany ..... 44 22 574.1

[51] Int. Cl.[6] ..... D01G 7/06; D01G 7/14
[52] U.S. Cl. ..... 19/80 R
[58] Field of Search ..... 19/80 R

[56] References Cited

U.S. PATENT DOCUMENTS

| | | | |
|---|---|---|---|
| 4,493,131 | 1/1985 | Dragagna et al. | 19/80 R |
| 4,660,257 | 4/1987 | Binder et al. | 19/80 R |
| 4,723,344 | 2/1988 | Leifeld | 19/105 |
| 5,105,507 | 4/1992 | Staheli et al. | 19/80 R |
| 5,105,508 | 4/1992 | Aebli et al. | 19/80 R |
| 5,189,308 | 2/1993 | Kortlang et al. | 19/80 R X |
| 5,329,668 | 7/1994 | Schlichter | 19/80 R X |

FOREIGN PATENT DOCUMENTS

| | | |
|---|---|---|
| 3245506 | 6/1983 | Germany . |
| 3315979 | 11/1984 | Germany . |
| 3926482 | 1/1991 | Germany . |
| 3943322 | 7/1991 | Germany . |
| 9116319 | 10/1992 | Germany . |
| 935547 | 6/1982 | U.S.S.R. . |
| 1060714 | 12/1983 | U.S.S.R. . |
| 2209711 | 5/1989 | United Kingdom . |

*Primary Examiner*—John J. Calvert
*Attorney, Agent, or Firm*—Spencer & Frank

[57] ABSTRACT

A method of detaching fiber tufts from an upper surface of fiber bales by a detaching device. Each fiber bale has, prior to performing a detaching operation thereon, a height portion defining an upper zone in which a fiber density increases downwardly; a height portion defining a lower zone in which the fiber density decreases downwardly; and a height portion defining a middle zone in which the fiber density is at a maximum, constant value as viewed vertically. The method includes the steps of propelling the detaching device at a travelling speed above the fiber bales in forward and return passes; detaching fiber tufts from the upper bale surface during the passes; periodically displacing the detaching device with a vertical feed as the bales are consumed; advancing the removed fiber tufts to a fiber tuft advancing device; and varying the travelling speed as a function of the decreasing actual height of the fiber bales.

21 Claims, 5 Drawing Sheets

METHOD AND APPARATUS FOR DETACHING FIBER TUFTS FROM TEXTILE FIBER BALES AS A FUNCTION OF BALE HEIGHT

CROSS REFERENCE TO RELATED APPLICATIONS

This application claims the priority of German Application Nos. P 43 32 496.7 filed Sep. 24, 1993 and P 44 22 574.1 filed Jun. 28, 1994, which are incorporated herein by reference.

BACKGROUND OF THE INVENTION

This invention relates to a method and an apparatus for detaching fiber tufts from textile fiber bales formed of cotton, chemical fibers or the like. The apparatus has a detaching device which travels back-and-forth above the fiber bales and which may be lowered thereonto. The detaching device removes fiber tufts from the upper surface of the fiber bales and advances the fiber tufts to a tuft transporting device. The bale height is divided into at least three detaching zones.

The fiber bales are delivered to the spinning preparation plant in a compressed state. After removing the constraining ties, such as straps, wire or the like, the bales, by virtue of their natural resiliency, expand in a vertical direction. Consequently, the bales from which fiber tufts are to be removed do not have a uniform density as viewed in the vertical direction. The fiber bales have the greatest density in a mid zone. As a result of such an uneven density distribution, upon detaching fiber tufts from an originally upper bale zone lying above the mid zone and later, from an originally lower bale zone lying below the mid zone, less fiber tufts (by weight) are detached and delivered than during the fiber tuft detachment from the mid zone of the bale. This means that during a starting period and during a terminal period of the detaching operation performed on a bale series, the downstream-connected machines are supplied with less fiber material (measured in weight) per time unit than during the detaching period when fiber tufts are removed from the mid zone of the bales.

In accordance with a known process, the adaptation of the weight of the fiber tuft quantities (production quantities) delivered by the detaching device per time unit to the different bale densities is achieved by varying the vertical feed of the detaching device for consecutive passes. In such a method the depth of detaching operation in the upper bale zone in which the density of the fiber material increases downwardly, is gradually decreased from a predetermined maximum detaching depth down to a detaching depth determined for the mid zone. The upper bale zone is delimited by a predetermined number of passes of the detaching device. In the mid zone where the bale density is the greatest, the predetermined detaching depth is maintained constant to thus delimit such mid zone. In accordance with a further known process, in the lower bale zone (decreasing density in the vertical direction) additionally the detaching depth is gradually increased; the maximum detaching depth and the number of passes of the detaching device are predetermined. In case, however, the output quantities have to be rapidly altered and the vertical feed is altered during one or several passes, the difficulty is encountered that the upper surface of the bales will be wavy which is an undesirable phenomenon. It is a further disadvantage of the known process that the fiber tuft dimensions fluctuate when the detaching depth is altered.

SUMMARY OF THE INVENTION

It is an object of the invention to provide an improved method and apparatus of the above-outlined type from which the discussed disadvantages are eliminated and which, in particular, ensures an optimal detachment of the fiber tufts and, particularly, a uniform output weight and a uniform tuft size during the entire detaching operation performed on a fiber bale series until such bale series is fully consumed.

This object and others to become apparent as the specification progresses, are accomplished by the invention, according to which, briefly stated, the speed of back-and-forth travel of the detaching device is altered as a function of the actual height of the bale on which the detaching operation is performed.

Thus, according to the invention, the non-uniform density of the fiber bales in the upper and/or lower zones is compensated for by altering the travelling speed of the detaching device as a function of the actual height of the bales. The measures according to the invention ensure that no changes in the production quantities will occur in the fiber processing machines which are connected in a production line after (downstream of) the fiber tuft removing apparatus (bale opener). Thus, such downstream-arranged fiber processing machines receive a uniform supply of fiber material, that is, the unlike density of the fiber bales in the lower and/or upper bale zones is compensated for as early as the detaching operation by changing the travelling speed. According to a particularly advantageous feature of the invention, the travel speed alteration is combined with a vertical feed alteration to provide for a flexible adaptation of the detaching operation to the various bale thicknesses, for obtaining the required output and for ensuring uniform fiber tuft dimensions.

DESCRIPTION OF THE PREFERRED EMBODIMENTS

Figure 1:
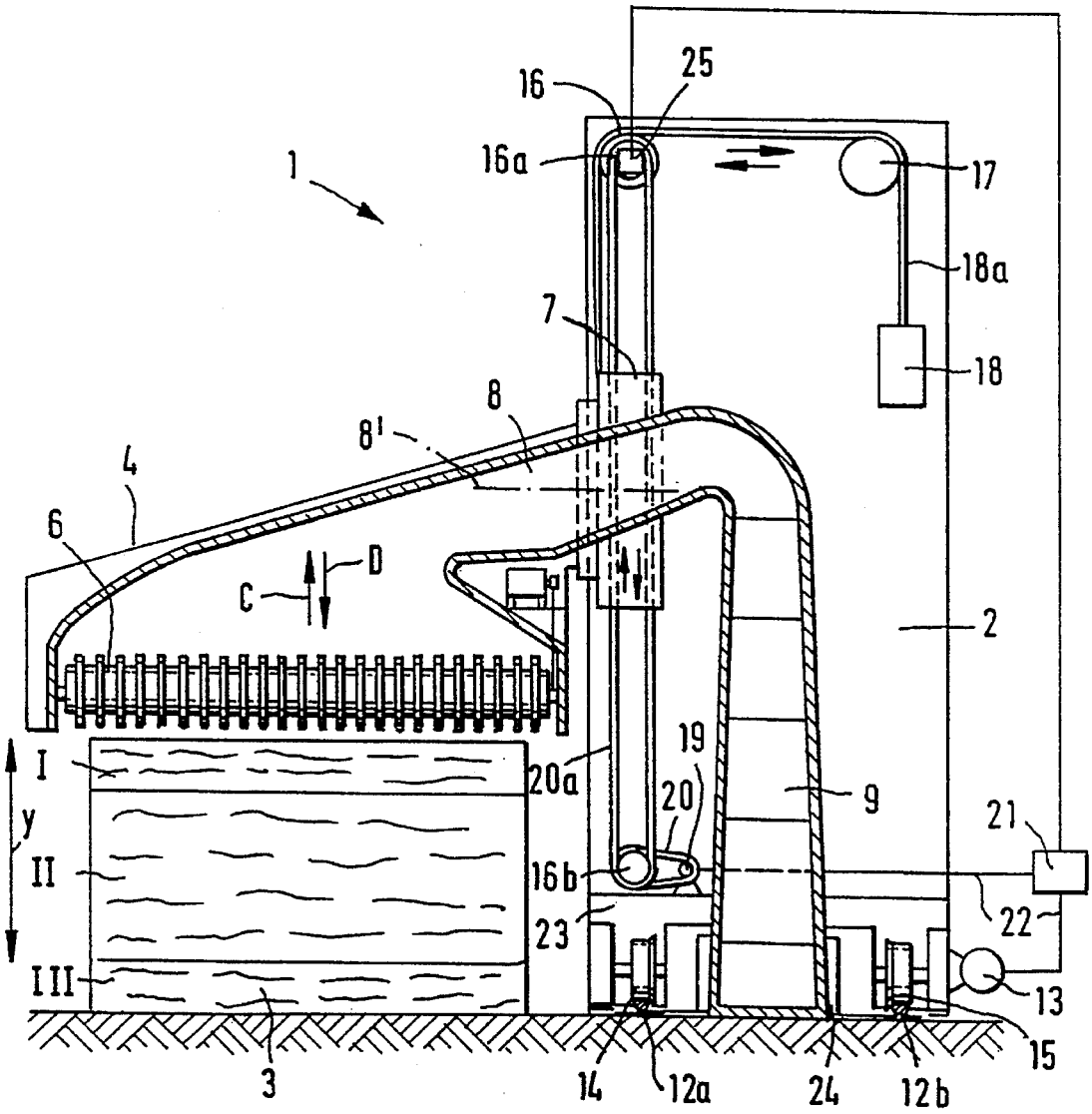
FIG. 1 is a schematic sectional front elevational view of a travelling bale opener incorporating the invention.
Figure 2A:
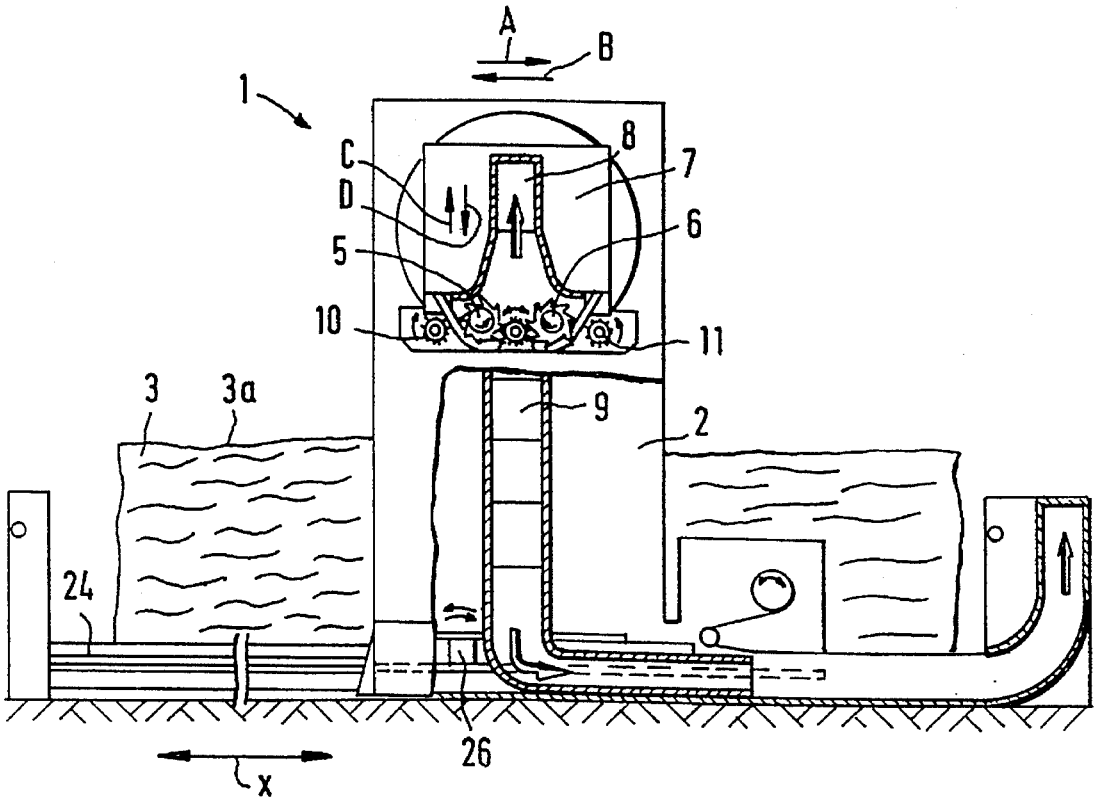
FIG. 2*a* is a schematic sectional side elevational view of the apparatus shown in FIG. 1.
Figure 3:
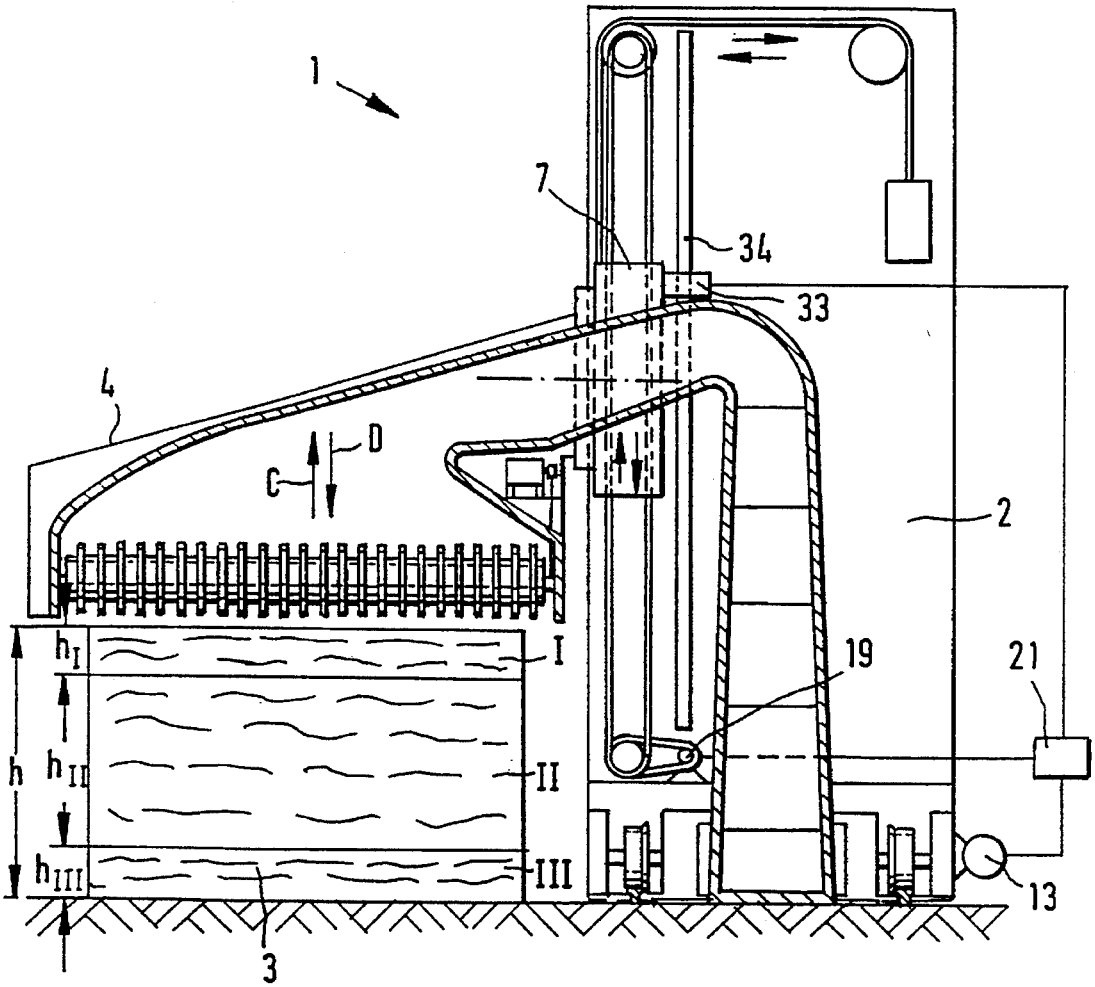
FIG. 3 is a schematic sectional front elevational view of a bale opener including a location transmitter for height position determination.

Turning to FIGS. 1, 2*a* and 3, there is illustrated therein a bale opener 1 which may be, for example, a BLEN- DOMAT BDT model, manufactured by Trützschler GmbH & Co. KG, Mönchengladbach, Germany. The bale opener 1 which detaches fiber tufts from the top of fiber bales arranged in a fiber bale series 3 has a tower 2 which travels back-and-forth in the direction of arrows A and B parallel to the bale series 3. The bale opener tower 2 supports, by means of a holding device 7, a laterally projecting detaching device 4 which has a rapidly rotating detaching mechanism, formed, for example, of two oppositely rotating, parallel arranged opening rolls (detaching rolls) 5 and 6. The fiber tufts detached by the opening rolls 5 and 6 are carried away by suction through a suction hood in which the detaching rolls 5 and 6 are disposed and a suction duct 9 pneumatically coupled to the hood. The detaching device 4 further has two slowly rotating pressing rolls 10 and 11 arranged parallel to the detaching rolls 5 and 6. The detaching device 4 may be vertically lowered or raised as indicated by the arrows C and D. The bale opener 1 works on the upper face 3*a* of the bale series 3 in a horizontal direction.

Referring in particular to FIG. 1, the tower 2 is supported on a carriage 23 which runs on rails 12*a*, 12*b* oriented parallel to the length of the bale series 3. The carriage wheels 14 and 15 are driven by a propelling motor 13 which may be an rpm-variable, frequency-controlled asynchronous motor and by means of which the travelling speed v of the bale opener is set or changed. The holding device 7 supporting the detaching device 4 is suspended by means of a cable 18*a* and end rollers 16, 17 and is balanced by a counterweight 18. A lifting motor 19, which may be an rpm-variable, frequency-controlled asynchronous motor is mounted on the carriage 23 and applies a raising or lowering force on the detaching device 4 by belt or chain transmission elements 20, 20*a*.

The displacement of the carriage 23, the tower 2 and the detaching device 4 as a unit in the horizontal direction (x-coordinate in FIG. 2*a*) by the propelling motor 13 and the displacement of the detaching device 4 in the vertical direction (y-coordinate in FIG. 1) by the lifting motor 19 are coordinated by a control apparatus 21 connected to the motors 13 and 19 by control cables 22 as will be discussed later with reference to FIG. 4. The tower 2 is mounted on the carriage 23 for rotation about a vertical axis.

The suction conduit 9 opens into a suction channel 24 which is fixed on the floor between the rails 12*a*, 12*b* and extends parallel thereto. For determining the location of the detaching device in the vertical direction (y-axis), an angular position transmitter 25 is affixed to the deflecting roller 16.

The various vertically superposed bale zones have the following characteristics:

Zone I: designated as the upper bale zone having a height $h_I$ and a fiber material density which increases in a downward direction.

Zone II: designated as the middle bale zone having a height $h_{II}$ and a constant, maximum fiber material density.

Zone III: designated as the lower bale zone having a height $h_{III}$ and is characterized by a fiber material density which decreases downwardly.

Figure 2B:
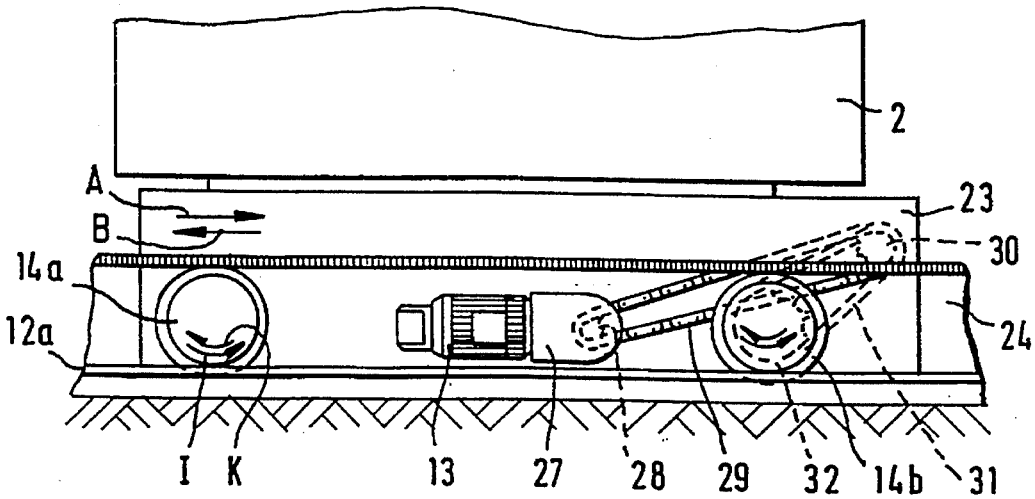
FIG. 2*b* is an enlarged schematic side elevational detail of the construction shown in FIG. 2*a*.

As shown in FIG. 2*b*, the propelling motor 13 transmits its driving torque to the wheel 14*b* of the carriage 23 with the intermediary of a gearing 27, a sprocket 28, a chain 29, a sprocket 20, a chain 31 and a sprocket 32.

Figure 4:
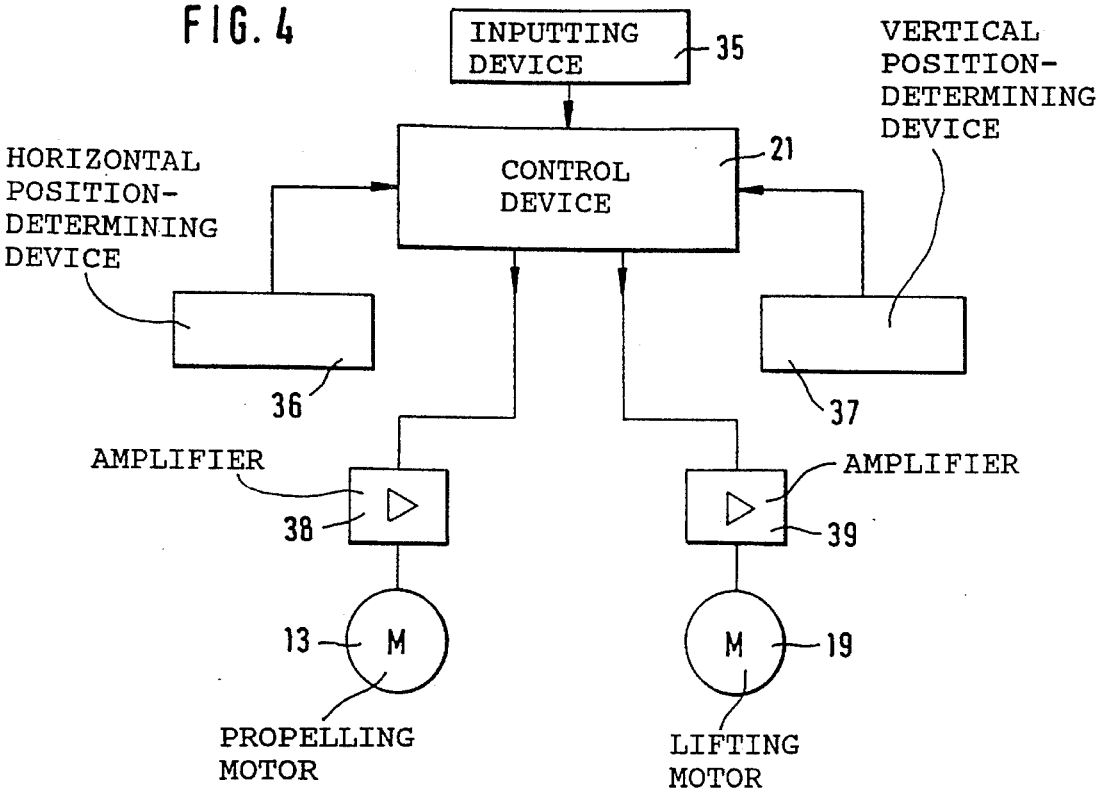
FIG. 4 is a block diagram of a control system for controlling the speed of a propelling motor and a lifting motor.

Turning to the block diagram of FIG. 4, there is shown a control device 21 which may be a microcomputer coupled with an inputting device 35. The control device 21 is coupled with a position-determining device 36 for the horizontal travel (x-axis), such as an incremental rotary position indicator 26 mounted on the carriage 23 and a position-determining device 37 such as an incremental rotary position indicator 25 mounted on the end roller 16 for the vertical displacement (y-axis). As an alternative, the height position-determining device may include, as shown in FIG. 3, a magnet 33, secured to the vertically movable holding device 7, cooperating with induction coils 34 mounted stationarily on the tower 2 in a vertical sequence. The control device 21 is further connected with the propelling motor 13 with the intermediary of an amplifier 38 (including a control electronics and/or a frequency converter) and with the lifting motor 19 with the intermediary of an amplifier 39.

Figure 5:
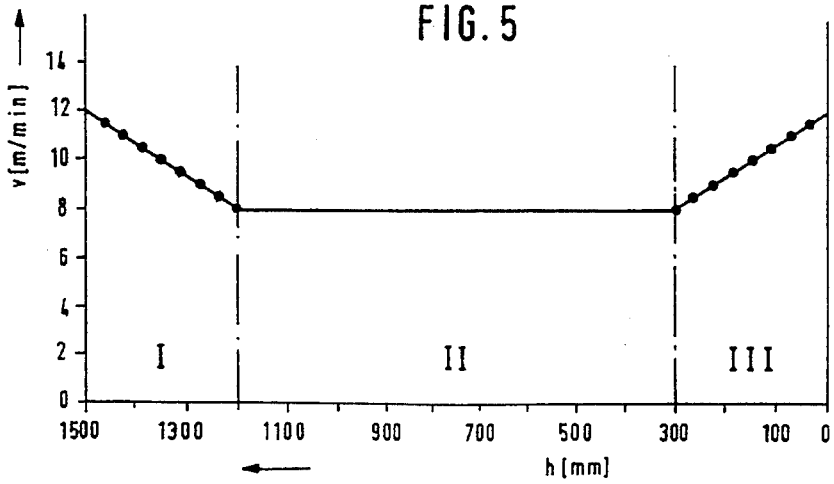
FIG. 5 is a diagram showing a bale opener travelling speed as a function of the actual height of the fiber bale submitted to a detaching operation.

As shown in FIG. 5, the travelling speed is, in the fiber bale zone I, reduced in eight steps of 0.5 m/min each, from 12 m/min to 8 m/min and in the zone III the travelling speed is increased in eight steps of 0.5 m/min each, from 8 m/min to 12 m/min. In zone II the travelling speed remains constant at 8 m/min. Such a function curve which thus represents the travelling speed v as a function of the actual momentary bale height h is, together with the initial bale height, inputted in the control device 21 and, accordingly, the travelling speed v is changed by the propelling motor 13 in the zones I and III.

Figure 6:
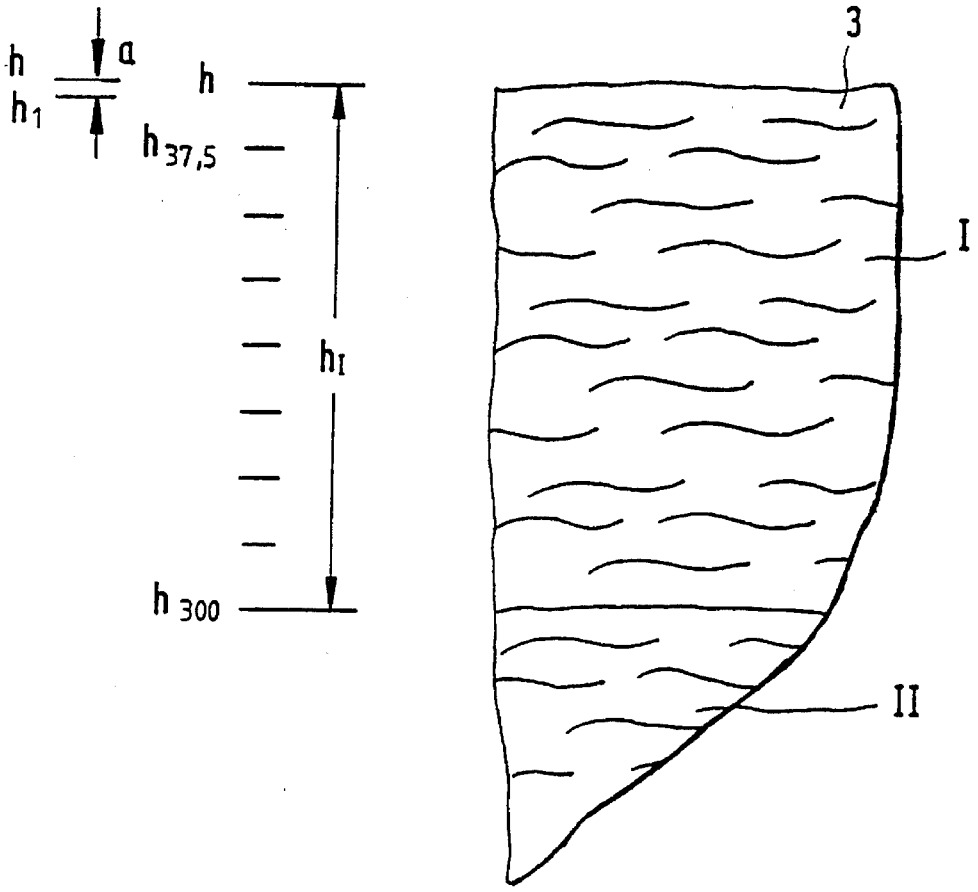
FIG. 6 is a fragmentary side elevational view of a fiber bale showing actual height values of the bale zone I.

FIG. 6 shows for the zone I the actual bale heights corresponding to the relationships shown in FIG. 5.

| | |
|---|---|
| Initial bale height: | h = 150 mm |
| Height of zone I: | $h_1 = 1500 - 1200 = 300$ mm |
| Feed: | a = 5 mm (constant) |
| Number of passes: | D = 300:5 = 60 |
| Actual height after the first pass: | $h_1 = 1500 - 5 = 1495$ mm |
| Number of the speed steps: | 8 |
| Actual bale height in the first speed step: | $h_{37.5} = 1500 - \frac{300}{8} = 1462.5$ mm |

At the actual height $h_{37.5}$ the travelling speed is lowered from 12.0 m/min to 11.5 m/min.

Figure 7:
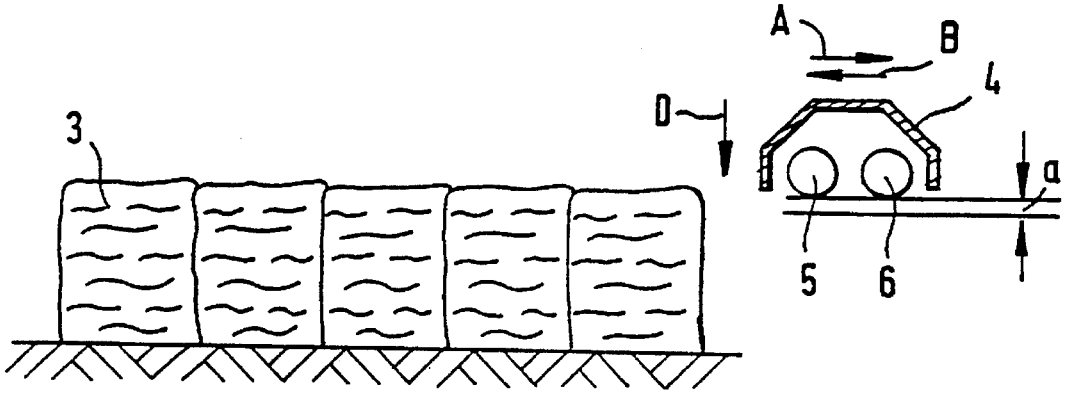
FIG. 7 is a schematic side elevational view of a row of fiber bales and a detaching device at the beginning of a pass and showing the change of the detaching depth a by lowering the detaching device.

Turning to FIG. 7, the detaching device 4 has been moved above the bale series 3 in the direction A to a position beyond the bale series 3. Subsequently, the detaching device 4 is lowered (direction D) by the inputted or calculated distance a (detaching depth or feed). Thereafter the detaching device 4 travels over the bale series 3 in the direction B. During the back-and-forth travel fiber tufts are removed by the detaching device 4 from the upper face 3*a* of the bale of the bale series 3.

In the description which follows, the process according to the invention will be set forth in more detail in conjunction with examples.

First, the magnitude of the vertical feed a is selected (set) by the inputter 35. For each fiber bale group (bale series) a feed a between 0.1 and 19.9 mm is inputted. The feed a is the thickness of a fiber material layer which, during each pass, is removed from the individual fiber bales or fiber bale series by the opening rolls 5, 6. The required feed a of the detaching device 4 is adapted to the required output.

The microcomputer (control device) 21 which may be a BLENDCOMMANDER BC model, manufactured by Trützschler GmbH & Co. KG, Mönchengladbach, Germany, automatically senses the height h (initial bale height) of the bale series that has been set up and the detected values are stored. The programming of the control device 21 is effected, for example, as disclosed in German Patent No. 3,335,793. For determining the bale group height h, the detaching device 4 carries three optical barriers: a frontal, upper optical barrier, a frontal, lower optical barrier and a rear optical barrier. A determination of the bale group height h is effected with the aid of all three optical barriers during the first pass (programming pass). In this operation the detaching device 4 travels such that its travel path approximately "hugs" the contour of the upper face 3*a* of the bales. The detection of the height is effected alternatingly by the two frontal optical barriers. The determination (detection) of the gap between bale groups is effected by the rear optical barrier. The momentary height of the detaching device 4, corresponding essentially to the bale height h, is stored in the control device 21 in short intervals. After the first pass, based on these data, average values are computed for the individual bale groups. The average values are used as the basis for further processing. The detaching device 4 travels above the bale series 3 and the machine detects the location of their beginning and end, as well as their height h while production is already in progress. The control device (computer) 21 divides the height of the bale series by the selected vertical feed a, resulting in the number of passes of the detaching device 4 which are required for completely consuming the bale series 3. The control device 21 divides the height of the other bale series by the computed number of passes; this results for each of these bale series in the feed a which is required to ensure that all bale series are simultaneously consumed.

After a one-time determination of the height h the latter is stored in the control device 21 and the actual height $h_1$–$h_n$ is in each instance corrected by the amount by which the detaching device 4 travels lower (feed a) during a pass. In this manner, the actual heights $h_1$–$h_n$ of the bale series are at all times known in the control device (computer) 21 and it is thus simple to vary the travel speed v as a function of such actual heights. There is a direct and exclusive relationship between the bale height h and the travelling speed v:

| Example: | Bale Height | Travelling Speed |
|---|---|---|
| | 1500–1400 | 12 m/min |
| | 1399–1200 | 11 m/min |
| | 1199–1100 | 10 m/min |
| | 1099–1000 | 9 m/min |
| | 999–300 | 9 m/min |
| | 299–200 | 8 m/min |
| | 199–100 | 10 m/min |
| | 99–0 | 11 m/min |

As to when a certain travelling speed v applies may be individually set and reproduced. The relationship between the bale height h and the travelling speed v is determined by an inputtable mathematical function. This function may be very simple (for example, purely linear) or relatively complex (for example, a cosine function or the like). Each once-determined and optimized relationship is storable in the program memory of the control device 21 so that it may be directly retrieved to reproduce an event. The determination and storage of the relationship between bale height h and travelling speed v is separately inputtable dependent on the present respective bale series 3 and working range. Further, the magnitude of the speed variation may be made additionally dependent of the set feed a, that is, in case of a very large feed a only a certain travelling speed v is permissible. In this manner the detaching device 4 may be protected from overload and possible clogging. The travelling speed v and the feed a may be varied as a function of the bale height $h_1$–$h_n$. The corresponding relationships are freely selectable, they may be stored and further, they may be retrieved at any time. In machines which have a monitor, a graphic programming is possible on the monitor screen. Travelling speed and/or feed profiles may be relatively easily produced, stored and retrieved.

The invention will be further explained by way of examples where the change of the travelling speed v and/or the feed a are given. Also encompassed are embodiments in which during one forward or reverse pass (as indicated by the arrows A and B, respectively) the travelling speed v is varied. Further, there are included embodiments in which the travelling speed v and/or the feed a are not varied at each forward or reverse pass, according to requirements. The travel speed v and/or the feed a may increase and decrease in the zone I and/or the zone III. As a rule, the travelling speed v and/or the feed a is constant within one forward or reverse pass. It is also possible to vary the feed a in the zones I and III in, for example, two to four steps. The steps of the speed variation are basically independent from the feed a.

As illustrated in FIG. 5, the travelling speed in zones I and III is, in each instance, changed in eight steps, while the number of passes is, however, substantially greater. According to the invention, the change of the travelling speed depends from the actual bale height. The speed change may, however, be combined with a feed change.

EXAMPLE 1

| | | |
|---|---|---|
| Zone I: | Travelling speed v | 12.0 m/min to 8 m/min (decreasing) in eight steps of 0.5 m/min each |
| | Feed a | 5 mm (constant) |
| Zone II: | Travelling speed v | 8 m/min (constant) |
| | Feed a | 5 mm (constant) |
| Zone III: | Travelling speed v | 8 m/min to 12.0 m/min (increasing) |
| | Feed a | 5 mm (constant) |

The increasing and decreasing density in the zones I and III is compensated for by the decreasing and, respectively, increasing travelling speed v (FIG. 5). The feed a is constant in all three zones I, II and III.

EXAMPLE 2

| | | |
|---|---|---|
| Zone I: | Travelling speed v | 12 m/min to 8 m/min (decreasing) in 8 stages, 0.5 m/min each |
| | Feed a | 6 mm (constant) |
| Zone II: | Travelling speed v | 10 m/min (constant) |
| | Feed a | 5 mm (constant) |
| Zone III: | Travelling speed v | 8 m/min to 12 m/min (increasing) |
| | Feed a | 6 mm (constant) |

The increasing and decreasing density in the zones I and III is compensated for by the decreasing and increasing travelling speed v. The constant speed v in the zone II is between the highest and, respectively, lowest travelling speed v in the zones I and III. The feed a is greater in zones I and III than in zone II. With the increased feed a the circumstance is taken into account that the density of the fiber material in the zones I and III is less than in the zone II. In this manner the effect of the travelling speed is counteracted. The travelling speed v may not exceed a predetermined maximum value; nevertheless, by means of the increased feed a a high travelling speed v may be achieved.

EXAMPLE 3

| | | |
|---|---|---|
| Zone I: | Travelling speed v | 10.0 m/min (constant) |
| | Feed a | 8 mm to 5 mm (decreasing) |
| Zone II: | Travelling speed v | 10.0 m/min (constant) |
| | Feed a | 5 mm (constant) |
| Zone III: | Travelling speed v | 8 m/min to 12 m/min (increasing) in eight steps, 0.5 m/min each |
| | Feed a | 6 mm (constant) |

The travelling speed v remains constant in zone I. The increasing density in zone I is compensated for by the decreasing feed a. Additionally, the decreasing feed a assists in the planarization (level equalization) of adjoining bales of the bale series 3. Such equalization is needed, because based on the pressure and the nature of the fibers slight height differences may be present after the individual bales of the bale series expand upon removal of the bale ties. In zone III the decreasing density is compensated for by the increasing travelling speed v and a feed a which is increased with respect to that in zone II. The problem of different heights does not occur in zone III because the bales press with their weight (for example, 220 kg) on the zone III and also, they are supported on a planar floor in the plant. Therefore, in zone III a constant feed a may be selected.

In zone III the decreasing density is compensated for by varying the travelling speed v in combination with the constantly increased feed a.

EXAMPLE 4

| | | |
|---|---|---|
| Zone I: | Travelling speed v | 12.0 m/min to 10.0 m/min (decreasing) |
| | Feed a | 6 mm to 3 mm (decreasing) |
| Zone II: | Travelling speed v | 10.0 m/min (constant) |
| | Feed a | 3 mm (constant) |
| Zone III: | Travelling speed v | 10.0 to 12 m/min (increasing) |
| | Feed a | 3 mm to 6 mm (increasing) |

EXAMPLE 5

| | | |
|---|---|---|
| Zone I: | Travelling speed v | 10.0 m/min (constant) |
| | Feed a | 8 mm to 5 mm (decreasing) |
| Zone II: | Travelling speed v | 9.0 m/min (constant) |
| | Feed a | 6 mm (constant) |
| Zone III: | Travelling speed v | 8 m/min to 12 m/min (increasing) in eight steps 0.5 m/min each |
| | Feed a | 6 mm (constant) |

The feed a is gradually reduced in zone I from 8 mm to 5 mm. The lowest feed a of 5 mm is not equal to the feed a predetermined for the zone II; rather, in zone II an increased feed a of 6 mm is held constant. The thus increased output quantities are compensated for by a reduced travelling speed v of 9 m/min.

EXAMPLE 6

| | | |
|---|---|---|
| Zone I: | Travelling speed v | 10.0 m/min (constant) |
| | Feed a | 8 mm to 5 mm (decreasing) |
| Zone II: | Travelling speed v | 10.0 m/min (constant) |
| | Feed a | 6 mm and 4 mm (alternating) |
| Zone III: | Travelling speed v | 8 m/min to 12 m/min (increasing) in eight steps, 0.5 m/min each |
| | Feed a | 6 mm (constant) |

The feed a is gradually reduced in zone I from 8 mm to 5 mm. The lowest feed a of 5 mm is not the feed a determined for the zone II; rather, in zone II there is set an alternating feed of 6 mm and 4 mm. Thus, the feed a is not maintained constant in the zone II.

According to the Examples 5 and 6, the own weight of the bale presses on the zone III (rather the zone I) so that the looser layer in zone III is slightly denser (lesser height) than the loose layer in zone I. For this reason the loose layers in the zones I and III are compensated for in different ways, that is, in zone I by a reduction of the feed and in zone III by an increasing travelling speed.

In zones I and/or III the change of the density is compensated for by altering the travelling speed v and the feed a. This embodiment provides for a flexible adaptation of the detached fiber tuft quantities. The travelling speed v and the feed a may not exceed predetermined maximum values so that a mutual partial substitution or, as the case may be, a complementation is effected.

It is added that according to the invention it is also feasible to vary the travelling speed v as a function of the fill level and/or fiber material requirement of a storage device, mixer, fill chute, cleaner, card or other machine arranged downstream of the bale opener in the fiber processing line. The travelling speed v may also be altered as a function of the bale hardness.

It will be understood that the above description of the present invention is susceptible to various modifications, changes and adaptations, and the same are intended to be comprehended within the meaning and range of equivalents of the appended claims.

What is claimed is:

1. In a method of detaching fiber tufts from an upper surface of fiber bales by a detaching device, each fiber bale having, prior to performing a detaching operation thereon, a height portion defining an upper zone in which a fiber density increases downwardly; a height portion defining a lower zone in which the fiber density decreases downwardly; and a height portion defining a middle zone in which the fiber density is at a maximum, constant value as viewed vertically; including the steps of propelling the detaching device at a travelling speed above the fiber bales in forward and return passes;

detaching fiber tufts from the upper bale surface during the passes;

periodically displacing the detaching device with a vertical feed as the bales are consumed; and advancing the removed fiber tufts to a fiber tuft advancing device;

the improvement comprising the step of increasing said travelling speed in said lower zone as a function of the decreasing actual height of the fiber bales.

2. The method as defined in claim 1, further comprising the step of decreasing the travelling speed in said upper zone as a function of the decreasing actual height of the fiber bales.

3. The method as defined in claim 1, further comprising the step of varying the travelling speed by a predetermined program.

4. The method as defined in claim 1, further comprising the step of varying said travelling speed at the end of a pass.

5. The method as defined in claim 1, wherein the travelling speed is linearly varied.

6. The method as defined in claim 1, further comprising the step of varying said travelling speed during a pass.

7. The method as defined in claim 1, further comprising the step of varying the travelling speed in a plurality of consecutive steps.

8. The method as defined in claim 1, further comprising the step of varying said travelling speed as a function of a required output of the detaching device.

9. The method as defined in claim 1, wherein the step of varying the travelling speed includes the steps of reducing the travelling speed in said upper zone from a predetermined first speed to a predetermined second speed, and propelling said detaching device in said middle zone at said second speed.

10. The method as defined in claim 9, wherein the step of varying the travelling speed includes the step of increasing the travelling speed in said lower zone from said second speed to a third speed.

11. The method as defined in claim 10, further comprising the step of maintaining said feed constant throughout said upper, middle and lower zones.

12. The method as defined in claim 10, wherein said feed is greater in said upper and lower zones than in said middle zone.

13. The method as defined in claim 1, further comprising the step of varying the feed in at least one of said upper zone and said lower zone.

14. The method as defined in claim 13, further comprising the step of varying the feed in a plurality of consecutive steps.

15. The method as defined in claim 13, further comprising the steps of reducing the feed in said upper zone from a predetermined first feed to a predetermined second feed, and displacing said detaching device in said middle zone with said second feed.

16. The method as defined in claim 15, wherein the step of varying the feed includes the steps of increasing the feed in said lower zone from said second feed to a third feed.

17. A fiber bale opener for detaching fiber tufts from upper surfaces of fiber bales arranged in a fiber bale series, comprising (a) a tower movable along the fiber bale series;

(b) a propelling motor for displacing said tower along the fiber bale series;

(c) a fiber tuft detaching device supported on said tower and projecting laterally therefrom; said detaching device travelling above the fiber bale series and removing fiber tufts from the top surfaces of the fiber bales during travel of said tower along the fiber bale series;

(d) a lifting motor for raising and lowering said detaching device relative to said tower; and (e) a control and regulating apparatus connected to said propelling motor and said lifting motor for controlling the speed of at least said propelling motor as a function of a height position of said detaching device.

18. The fiber bale opener as defined in claim 17, further comprising (f) a first position determining device connected to said control and regulating apparatus for applying signals thereto representing a location of said tower along a travel path thereof; and (g) a second position determining device connected to said control and regulating apparatus for applying signals thereto representing a vertical position of said detaching device relative to said tower.

19. In a method of detaching fiber tufts from an upper surface of fiber bales by a detaching device, each fiber bale having, prior to performing a detaching operation thereon, a height portion defining an upper zone in which a fiber density increases downwardly; a height portion defining a lower zone in which the fiber density decreases downwardly; and a height portion defining a middle zone in which the fiber density is at a maximum, constant value as viewed vertically; including the steps of propelling the detaching device at a travelling speed above the fiber bales in forward and return passes;

detaching fiber tufts from the upper bale surface during the passes;

periodically displacing the detaching device with a vertical feed as the bales are consumed; and advancing the removed fiber tufts to a fiber tuft advancing device;

the improvement comprising the steps of maintaining said travelling speed constant in said upper and middle zones and increasing said travelling speed in said lower zone and reducing said feed in said upper zone as a function of the decreasing actual height of the fiber bales, and maintaining said feed constant in said middle and lower zones.

20. In a method of detaching fiber tufts from an upper surface of fiber bales by a detaching device, each fiber bale having, prior to performing a detaching operation thereon, a height portion defining an upper zone in which a fiber density increases downwardly; a height portion defining a lower zone in which the fiber density decreases downwardly; and a height portion defining a middle zone in which the fiber density is at a maximum, constant value as viewed vertically; including the steps of propelling the detaching device at a travelling speed above the fiber bales in forward and return passes;

detaching fiber tufts from the upper bale surface during the passes;

periodically displacing the detaching device with a vertical feed as the bales are consumed; and advancing the removed fiber tufts to a fiber tuft advancing device;

the improvement comprising the steps of reducing said travelling speed and said feed in said upper zone as a function of the decreasing actual height of the fiber bales, maintaining said travelling speed and said feed constant in said middle zone and increasing said travelling speed and said feed in said lower zone as a function of the decreasing actual height of the fiber bales.

21. In a method of detaching fiber tufts from an upper surface of fiber bales by a detaching device, each fiber bale having, prior to performing a detaching operation thereon, a height portion defining an upper zone in which a fiber density increases downwardly; a height portion defining a lower zone in which the fiber density decreases downwardly; and a height portion defining a middle zone in which the fiber density is at a maximum, constant value as viewed vertically; including the steps of propelling the detaching device at a travelling speed above the fiber bales in forward and return passes;

detaching fiber tufts from the upper bale surface during the passes;

periodically displacing the detaching device with a vertical feed as the bales are consumed; and advancing the removed fiber tufts to a fiber tuft advancing device;

the improvement comprising the steps of reducing said feed in said upper zone and increasing said travelling speed in said lower zone as a function of the decreasing actual height of the fiber bales.

* * * * *